US006928361B2

(12) United States Patent
Nakayama et al.

(10) Patent No.: US 6,928,361 B2
(45) Date of Patent: Aug. 9, 2005

(54) CONTROL APPARATUS FOR MOTOR VEHICLE AND STORAGE MEDIUM

(75) Inventors: Shigeki Nakayama, Susono (JP); Toshio Suematsu, Toyota (JP); Takao Fukuma, Susono (JP); Tomihisa Oda, Susono (JP); Yasuo Harada, Susono (JP); Akio Matsunaga, Susono (JP); Tomoyuki Ono, Susono (JP); Teruhiko Miyake, Susono (JP); Yoshitsugu Suzuki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 70 days.

(21) Appl. No.: 10/399,734

(22) PCT Filed: Oct. 31, 2001

(86) PCT No.: PCT/IB01/02045

§ 371 (c)(1),
(2), (4) Date: May 29, 2003

(87) PCT Pub. No.: WO02/37076

PCT Pub. Date: May 10, 2002

(65) Prior Publication Data

US 2004/0098190 A1 May 20, 2004

(30) Foreign Application Priority Data

Nov. 2, 2000 (JP) ..... 2000-336348

(51) Int. Cl.[7] ..... F02D 41/14

(52) U.S. Cl. ..... 701/104; 701/105; 701/109; 701/114; 701/115

(58) Field of Search ..... 701/101–115

(56) References Cited

U.S. PATENT DOCUMENTS

| | | | | |
|---|---|---|---|---|
| 4,008,423 | A | | 2/1977 | Christianson et al. |
| 4,676,215 | A | | 6/1987 | Blocher et al. |
| 5,231,344 | A | | 7/1993 | Marumoto et al. |
| 5,293,852 | A | | 3/1994 | Lehner et al. |
| 5,351,776 | A | | 10/1994 | Keller et al. |
| 5,682,317 | A | * | 10/1997 | Keeler et al. ..... 701/101 |
| 5,988,844 | A | | 11/1999 | Timm et al. |
| 6,230,486 | B1 | | 5/2001 | Yasui et al. |
| 6,269,300 | B1 | * | 7/2001 | Moore-McKee et al. ... 701/102 |

FOREIGN PATENT DOCUMENTS

| | | |
|---|---|---|
| EP | 0 568 127 A2 | 11/1993 |
| EP | 1 010 882 A2 | 6/2000 |
| JP | A 10-184431 | 7/1998 |

* cited by examiner

*Primary Examiner*—Andrew M. Dolinar
(74) *Attorney, Agent, or Firm*—Oliff & Berridge, PLC

(57) ABSTRACT

A control apparatus for a motor vehicle is provided in which each of a plurality of output values of the vehicle varies depending upon a plurality of input control parameters for controlling the vehicle. The control apparatus changes the input control parameter or parameters so that each of the output values becomes substantially equal to a corresponding target output value. The control apparatus then determines adapted values of the input control parameters, based on values of the input control parameters obtained when each of the output values becomes substantially equal to the corresponding target output value or falls within a permissible adaptation range of the target output value.

46 Claims, 7 Drawing Sheets

CONTROL APPARATUS FOR MOTOR VEHICLE AND STORAGE MEDIUM

BACKGROUND OF THE INVENTION

1. Field of the Invention

The invention relates to a control apparatus for a motor vehicle, and a storage medium that stores a program that causes a computer to perform the functions of the control apparatus.

2. Description of Related Art

In the development of a new internal combustion engine, for example, a so-called adaptation operation is conventionally performed so as to search for appropriate input control parameter values of the engine that can provide optimum engine output values. In the adaptation operation, the respective values of the input control parameters, such as a fuel injection amount and fuel injection timing, are gradually changed based on experiences over a long period of time, to provide adapted values of the input control parameters that can yield the optimum engine output values, for example, the optimum engine output torque, fuel economy, and amounts of exhaust emissions. A similar adaptation operation is also performed in the development of a new vehicle.

In searching for the adapted values of the input control parameters based on experiences, however, it becomes more difficult to find out the optimum adapted values of the respective input control parameters as the number of the input control parameters increases. In addition, it takes a long time to find out the adapted values of the input control parameters, resulting in increased time and labor required for the development of the vehicle.

SUMMARY OF THE INVENTION

It is an object of the invention to provide a control apparatus for a motor vehicle, which allows an adaptation operation for input control parameters of the vehicle or an engine to be automatically performed on-board, and a storage medium that stores a program for performing the adaptation operation.

To accomplish the above and/or other objects, there is provided according to one aspect of the invention a control apparatus for a motor vehicle, in which each of a plurality of output values of the vehicle varies depending upon a plurality of input control parameters for controlling the vehicle. The control apparatus includes (a) an adaptive control unit that changes the input control parameter or parameters so that each of the output values becomes substantially equal to a corresponding target output value, and (b) an adapted value setting unit that determines adapted values of the input control parameters, based on values of the input control parameters obtained when each of the output values becomes substantially equal to the corresponding target output value or falls within a permissible adaptation range of the target output value.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENT

Figure 1:
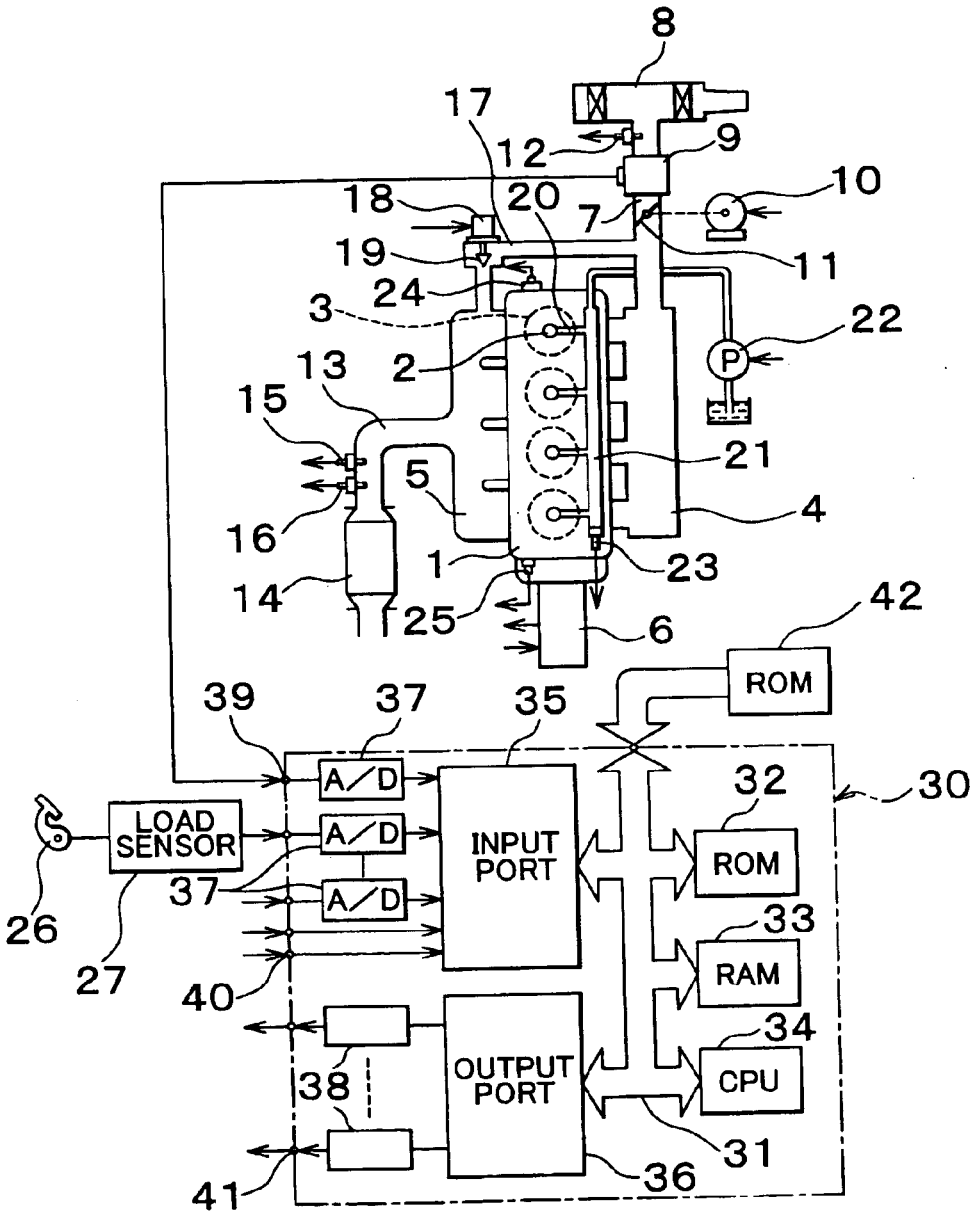
FIG. 1 is a schematic view showing an internal combustion engine and a control apparatus for a motor vehicle according to one preferred embodiment of the invention.

FIG. 1 shows an internal combustion engine mounted on a vehicle, which includes a vehicle control apparatus according to one preferred embodiment of the invention. While the internal combustion engine of FIG. 1 is of a four-cylinder compression ignition type, the invention may also be applied to an internal combustion engine of a spark ignition type.

The internal combustion engine shown in FIG. 1 is provided with an engine body 1, an electrically controlled fuel injection valve 2 for injecting fuel toward a combustion chamber of each cylinder 3, an intake manifold 4, and an exhaust manifold 5. Also, a manual or automatic transmission 6 is mounted on the engine body 1. The intake manifold 4 is connected to an air cleaner 8 via an intake duct 7, and an air flow meter 9 for detecting an amount of intake air is disposed in the intake duct 7. Further, a throttle valve 11 that is driven by an actuator 10 like a step motor is disposed in the intake duct 7 downstream of the air flow meter 9, while a temperature sensor 12 for detecting an intake air temperature is disposed in the intake duct 7 upstream of the air flow meter 9.

In the meantime, the exhaust manifold 5 is connected to a catalytic converter 14 via an exhaust duct 13. A NOx sensor 15 for detecting a NOx concentration of exhaust gas and a temperature sensor 16 for detecting an exhaust gas temperature are disposed in the exhaust dust 13. A portion of the intake duct 7 located downstream of the throttle valve 11 and the exhaust manifold 5 are connected to each other via an exhaust gas recirculation (hereinafter, referred to as EGR) passage 17. Further, an EGR control valve 19 that is driven by an actuator 18, such as a step motor, is disposed in the EGR passage 17.

In the meantime, the fuel injection valve 2 for each cylinder is connected, via a fuel supply duct 20, to a fuel reservoir, or so-called common rail 21. The common rail 21 is supplied with fuel from an electrically controlled fuel pump 22 capable of discharging a variable amount of fuel. The fuel thus supplied to the common rail 21 is supplied to the fuel injection valves 2 via the respective fuel supply ducts 20. A fuel pressure sensor 23 for detecting a fuel pressure is mounted in the common rail 21. On the basis of a signal generated by the fuel pressure sensor 23, a discharge amount of the fuel pump 22 (i.e., an amount of fuel discharged from the fuel pump 22) is controlled so that a fuel pressure in the common rail 21 becomes equal to the target fuel pressure.

The engine body 1 is provided with an engine speed sensor 24 for detecting an engine speed, and is also provided with a vibration sensor 25 for detecting vibration of the engine body 1. In addition, an acceleration pedal 26 disposed in the vehicle is connected to a load sensor 27 for generating an output voltage that is proportional to a depressed amount of the acceleration pedal 26.

A vehicle control apparatus 30 includes a digital computer including a ROM (read only memory) 32, a RAM (random access memory) 33, a CPU (microprocessor) 34, an input port 35, and an output port 36, which are connected to each other via a bidirectional bus 31. The digital computer further includes analog to digital (A/D) converters 37 connected to the input port 35, and driving circuits 38 connected to the output port 36. As shown in FIG. 1, a signal indicating a shift position or speed ratio of the transmission 6 and output signals of various sensors as indicated above are transmitted to input terminals 29 of the corresponding A/D converters 37 or directly to input terminals 40 of the input port 35. The output signals may include those of the air flow meter 9, the temperature sensor 12, the NOx sensor 15, the temperature sensor 16, the fuel pressure sensor 23, the engine speed sensor 24, the vibration sensor 25, and the load sensor 27. On the other hand, output terminals 41 of the driving circuits 38 are respectively connected to the fuel injection valves 2, the transmission 6, the actuator 10 for the throttle valve 11, the actuator 18 for the EGR control valve 19 and the fuel pump 22.

The vehicle control apparatus 30 may be used in common for various types of vehicles or internal combustion engines. Also, the vehicle control apparatus 30 may be replaced by another one as needed. Further, a replaceable or removable storage medium 42, such as a CD-ROM, may be connected to the bidirectional bus 31 of the vehicle control apparatus 30. In addition, various detection sensors (not shown in FIG. 1) associated with the vehicle are connected to the input terminals 39, 40 of the vehicle control apparatus 30, and the output terminals 41 of the vehicle control apparatus 30 are connected to various actuators (not shown in FIG. 1) for controlling the vehicle.

An adaptation operation for the vehicle is basically interpreted to mean an operation to search for appropriate values of input control parameters of the vehicle so that each of output values of the vehicle becomes equal to a corresponding target output value. In the following description, an adaptation operation for the engine, which is typically included in the adaptation operation for the vehicle, will be explained in detail by way of example.

Like the adaptation operation for the vehicle as described above, the adaptation operation for the engine is basically interpreted to mean an operation to search for appropriate values of input control parameters of the engine so that each of engine output values becomes equal to a corresponding target output value. In this case, the input control parameters include: the fuel injection amount, fuel injection timing, fuel injection pressure, amount of fuel subjected to pilot injection performed prior to main fuel injection, intake air amount, intake air temperature, oxygen concentration of the intake air supplied into the combustion chamber, and the like. The engine output values include: the engine output torque, fuel economy or fuel consumption, amounts of exhaust emissions, such as NOx, HC, and CO, smoke concentration in the exhaust gas, combustion noise, vibration of the engine, exhaust gas temperature, and the like.

As described above, many input control parameters of the engine and many engine output values as described above may be employed for the adaptation operation for the engine. For the sake of the brevity, however, there will be hereinafter explained an example of an adaptation operation in which the fuel injection amount, the fuel injection timing, the fuel injection pressure, the pilot injection amount, and the oxygen concentration in the intake air are used as the input control parameters of the engine, and the engine output torque, the fuel economy or fuel consumption, the NOx amount in the exhaust gas, the smoke concentration in the exhaust gas, and the combustion noise are used as the engine output values. In this connection, the fuel economy may be represented by a vehicle running distance per unit amount of fuel consumption, or an amount of fuel consumed per unit running distance of the vehicle. The fuel economy improves when the running distance per unit fuel amount increases, and deteriorates when the running distance decreases. In other words, the fuel economy improves when the fuel consumption amount per unit running distance decreases, and deteriorates when the fuel consumption amount increases. In order to avoid confusion, therefore, the fuel economy is simply said to be good (or improved) or to be poor (or deteriorated) in the description of the specification.

In operation, if one of the input control parameters, for example, the fuel injection amount, is changed, many output values, more specifically, the engine output torque, the fuel economy, the NOx amount, the smoke concentration and the combustion noise, change with the fuel injection amount. When an adaptation operation is performed according to one embodiment of the invention, each of the input control parameter values is changed so that each of the output values becomes equal to the corresponding target output value. More specifically, in the embodiment of the invention, a combination of one or more input control parameters suitable for adaptive control, with each output value, is predetermined, and the respective input control parameters are simultaneously feedback-controlled so that the output values that are in combination with each of the input control parameters become equal to the corresponding target output values, respectively.

As described above, when the respective input control parameters are simultaneously feedback-controlled, each of the input control parameter values is automatically changed while being coordinated with other parameters until each of the output values becomes equal to the corresponding target value, thereby to achieve adaptation of the input control parameters.

In some cases, however, no input control parameter values actually exist which can make all of the output values equal to the corresponding target output values. In these cases, even if the respective input control parameters are simultaneously feedback-controlled, all of the output values will not become equal to the corresponding target output values. However, adaptation of the input control parameters may be achieved provided that the output values are controlled to be within respective permissible ranges even if they do not become exactly equal to the target output values. Thus, in the present embodiment of the invention, adaptation of the input control parameters is judged as being accomplished when each of the output values falls within a permissible or adaptive range of the corresponding target output value even if it does not become exactly equal to the corresponding output value.

Figure 2:
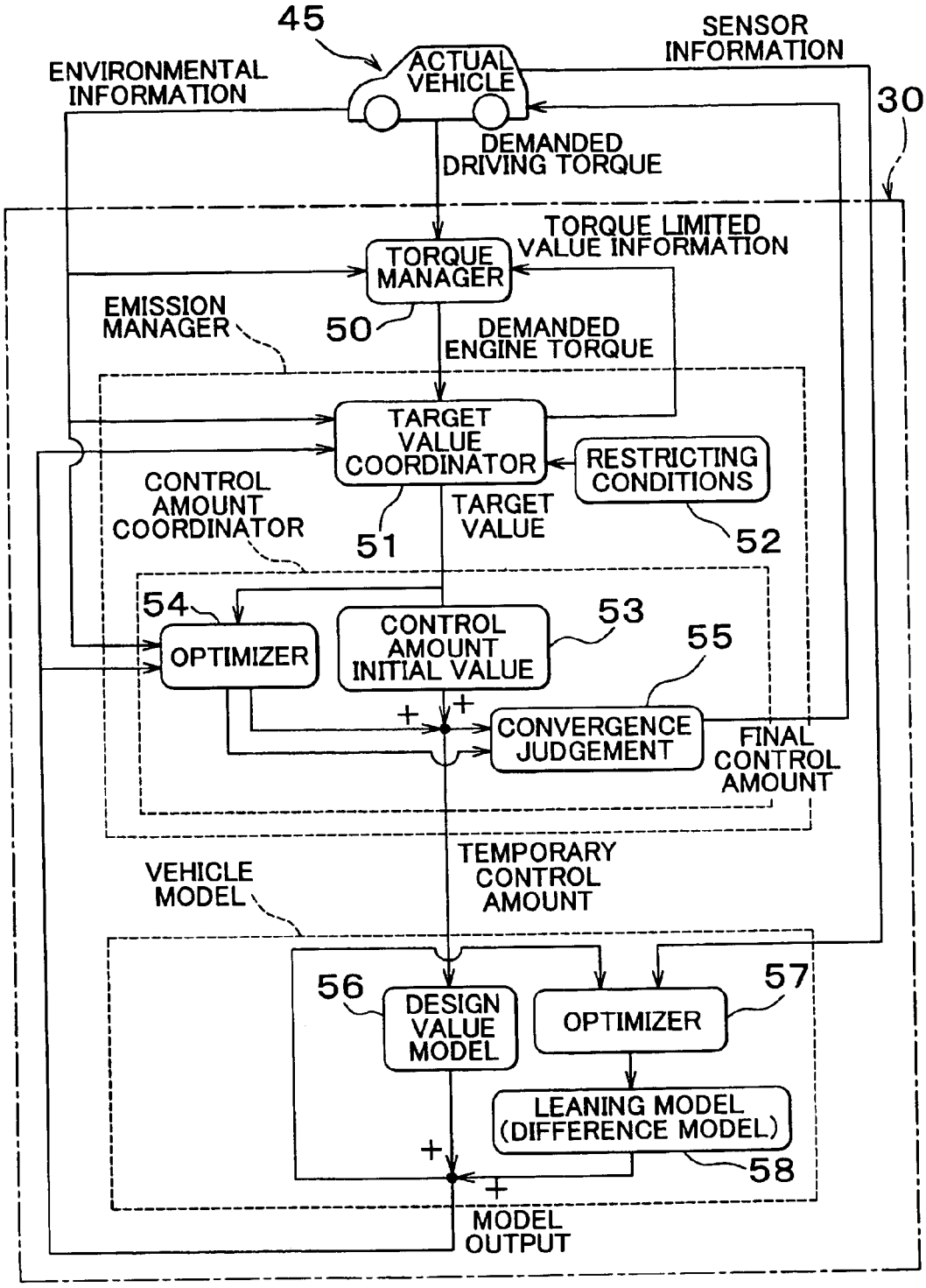
FIG. 2 is a block diagram showing a system that performs an adaptation operation and engine control.

Referring next to FIG. 2, the adaptation operation according to the above embodiment of the invention will be more specifically explained. FIG. 2 is a block diagram showing a system for the adaptation operation and engine control that are performed on-board by the vehicle control apparatus 30. Reference numeral 45 in FIG. 2 denotes a vehicle in which the internal combustion engine shown in FIG. 1 is installed.

Referring to FIG. 2, the system for the adaptation operation and engine control principally consists of three function blocks, namely, a function block 50 called a torque manager, a function block called an emission manager, and a function block called a vehicle model. The emission manager consists of a function block 51 called a target value coordinator, a function block 52 called restricting conditions, and a function block called an control amount coordinator.

The above-described control amount coordinator consists of a function block 53 called a control amount initial value, a function block 54 called an optimizer, and a function block 55 called convergence judgment. The vehicle model consists of a function block 56 called a design value model, a function block 57 called an optimizer, and a function block 58 called a learning model.

Next, the function of each function block in FIG. 2 will be explained one by one.

As shown in FIG. 2, the torque manager 50 receives information on a demanded driving torque and an environmental information from the vehicle 45. The demanded driving torque, which is a driving torque demanded or requested by the driver of the vehicle 45, is proportional to the depressed amount of the acceleration pedal 26 provided in the vehicle 45. The environmental information include the engine speed detected by the engine speed sensor 24 and the shift or gear position or speed ratio of the transmission 6. The torque manager 50 calculates a demanded engine torque based on the information indicative of the demanded driving torque, the engine speed, and the shift or gear position, and information relating to the demanded engine torque is transmitted to the target value coordinator 51.

In addition to the information on the demanded torque and the environmental information, the target value coordinator 51 also receives output values of the vehicle model, and information relating to restricting conditions from the function block 52. The target value coordinator 51 sets target output values of the engine output values, based on the demanded torque, the environmental information, the output values of the vehicle model, and the restricting conditions.

The target output values set in the target value coordinator 51 may include the engine output torque, the fuel economy, the NOx amount, the smoke concentration, the combustion noise, and the like. In this case, since the engine is required to generate an output torque in accordance with the demanded torque, the target value of the output torque is set to the demanded torque. In some cases, however, the output torque must be restricted due to, for example, restrictions on the amounts of exhaust emissions, or the like. The target value coordinator 51 determines whether the output torque must be restricted, and if the coordinate 51 determines that the output torque must be controlled, information relating to a limit value of the output torque is transmitted from the target value coordinator 51 to the torque manager 50, as shown in FIG. 2.

When the torque manager 50 receives the information about the limit value of the output torque, it restricts the demanded torque so that the demanded torque received by the target coordinator 51 does not exceed the limit value of the demanded torque. In this case, therefore, the target value of the output torque is set to the restricted demanded torque.

One of the above-indicated target output values set in the target value coordinator 51 may be that of the fuel economy. It is, however, not necessary to particularly determine or set a target value of the fuel economy because the better the fuel economy is, the more desirable it is. To the contrary, deterioration of the fuel economy may result in an increased amount of $CO_2$ that is released to the air. Thus, in order to restrict the emission amount of $CO_2$, a limit to the fuel consumption may be set so that the fuel consumption is kept less than the set limit.

With regard to the other target value, it is naturally desirable to reduce the NOx amount, the smoke concentration and the combustion noise as much as possible. However, an attempt to reduce the NOx amount, the smoke concentration, or the combustion noise may result in a reduction in the engine output torque or deterioration of the fuel economy. Therefore, it may not be impossible to easily determine target values of the NOx amount, the smoke concentration and the combustion noise. In addition, different regulation values are imposed in different countries on the amounts of exhaust emissions, in particular, the NOx amount and the smoke concentration. Thus, the regulation values must also be taken into consideration in determining the target output values of the exhaust emission amounts.

In this case, typical regulations on the exhaust emissions are so-called mode emission regulations, which are imposed on the amounts of exhaust emissions when the vehicle is running in a predetermined driving mode. In the embodiment of the invention, the target output values of the exhaust emission amounts are set so as to satisfy the mode emission regulations. The setting of the target output values of the exhaust emission amounts involves the restricting conditions of the function block 52 and the vehicle model as shown in FIG. 2, both of which will be hereinafter described one by one.

In the embodiment as shown in FIG. 2, the restricting conditions of the function block 52 include mode emission regulation values associated with NOx, HC, CO, and the smoke concentration in the exhaust gas. The target coordinator 51 receives these mode emission regulation values from the function block 52. The mode emission regulation values may be stored in advance in the ROM 32 of the vehicle control apparatus 30, or may be stored in the replaceable storage medium 42.

On the other hand, the vehicle model outputs estimated output values of the actual vehicle 45 when it receives the input control parameters of the vehicle. For example, if the vehicle model receives the input control parameters, such as the fuel injection amount, the fuel injection timing, the fuel injection pressure, the pilot injection amount, and the oxygen concentration in the intake air, the vehicle model outputs estimated values, such as the engine output torque, the fuel economy, the NOx amount, the smoke concentration, and the combustion noise, in accordance with the input control parameters.

For example, the output torque of the engine is a function of the energy delivered to the engine, the ignition timing, and the combustion speed. Accordingly, once the specifications of the engine, such as the structure and dimensions of the combustion chambers, are determined, the engine output torque can be calculated from the input control parameter values, such as the fuel injection amount, the fuel injection timing, the fuel injection pressure, the intake air amount, the EGR gas amount, and the intake air temperature. The vehicle model outputs the thus calculated engine output torque as the estimated output torque of the actual vehicle 45.

With regard to the internal combustion engine, certain relationships are established between the input control parameters and the output values once the specifications of the engine, such as the structure, shape, and dimensions of the engine, are determined, as described above. The relationships may be represented by arithmetic expressions including coefficients that are determined by the dimensions, and the like, of each portion of the engine. In the embodiment as shown in FIG. 2, the design value model 56 in the vehicle model consists of the arithmetic expressions including these coefficients. Also, in the embodiment of FIG. 2, the values of the coefficients associated with the vehicle 45 to be controlled are stored in advance.

In the embodiment as shown in FIG. 2, when the vehicle to be controlled is replaced by another vehicle, the vehicle model, or the design value model 56, can be replaced by another vehicle model, or design value model 56, which is suited to the new vehicle. In this case, the vehicle model, or the design value model 56, may be stored in the replaceable storage medium 42.

Meanwhile, the vehicle model, or the design value model 56, contains coefficients determined by the dimensions, and the like, of each portion of the vehicle to be controlled, namely, coefficients determined by the specifications data of the vehicle to be controlled. Thus, the vehicle model, or the design value model 56, is completed once the specifications data of the vehicle to be controlled are determined. Accordingly, the specifications data of the vehicle to be controlled may be stored in the replaceable storage medium 42, and the vehicle model, or the design value model 56, may be completed by transmitting the specifications data of the vehicle to be controlled from the storage medium 42 to the vehicle model.

In the case where the output values of the design value model 56 coincide with the output values of the actual vehicle 45, the output values of the design value model 56 may be used as the output values of the vehicle model. Actually, however, there are some cases where the output values of the design value model 56 do not coincide with the output values of the actual vehicle 45. Particularly, as the vehicle 45 is used over a long period of time, the output values of the design value model 56 come to deviate from the output values of the actual vehicle 45 due to chronological changes thereof. Accordingly, in the embodiment as shown in FIG. 2, the design value model 56 is corrected or modified so that the output values of the vehicle model coincide with the output values of the actual vehicle 45. For this purpose, the vehicle model is provided with the optimizer 57 and the learning model 58.

In operation of the embodiment of FIG. 2, the sum of each of the output values of the design value model 56 and a corresponding one of output values of the learning model 58 is calculated, and the result of the calculation is regarded as the estimated output value of the vehicle model. The optimizer 57 receives the estimated output values of the vehicle model at one end, and receives, at the other end, sensor information including the output signals of the air flow meter 9, the temperature sensor 12, the NOx sensor 15, the temperature sensor 16, the fuel pressure sensor 23, the vibration sensor 25, and the like, and other information.

On the basis of a difference between each of the estimated output values of the vehicle model and the corresponding output value of the actual vehicle 45, the optimizer 57 adjusts the corresponding output value of the learning model 58 so that the difference becomes equal to zero. As a result, the estimated output values of the vehicle model respectively coincide with the output values of the actual vehicle 45 in the embodiment of FIG. 2. In this case, the output values of the design value model 56 may be corrected by the optimizer 57, without using the learning model 58, so that the output values of the vehicle model become equal to the output values of the actual vehicle 45.

In the embodiment of the invention as described above, the target coordinator 51 sets the target output values of the exhaust emission amounts so as to satisfy the mode emission regulations. In this case, the target coordinator 51 calculates the target output values of the exhaust emission amounts, based on the restricting conditions of the function block 52 and the vehicle model. Here, the restricting conditions are mode emission regulation values relating to NOx, HC, CO, and the smoke concentration in the exhaust gas. Next, a method of calculating the target output values of the exhaust emission amounts, or the like, using this vehicle model will be explained.

Figure 3A:
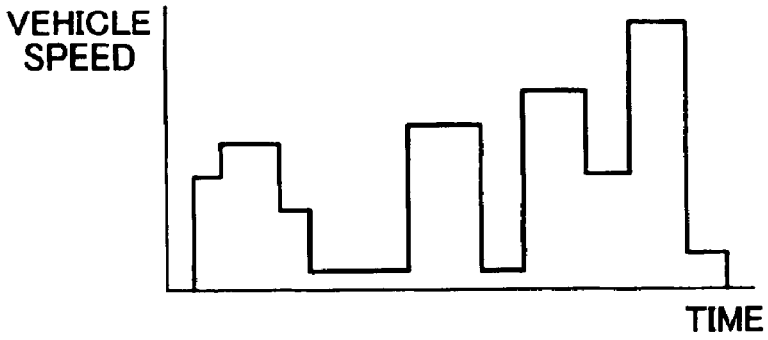
FIG. 3A is a graph showing an example of a driving mode.

In the present embodiment of the invention, the driving mode that is predetermined for the mode emission regulations are stored in advance. FIG. 3A shows an example of the driving mode, in which the vehicle speed is changed with time. Since various driving modes exist with respect to different sets of exhaust emission regulations, such driving modes may be stored in the replaceable storage medium or media 42 so that a driving mode corresponding to any set of the exhaust emission regulations can be employed.

Further, when the vehicle is moving from one area to another area in which the exhaust emission regulation values or the driving mode for the exhaust emission regulations are different from those in the previous area, it is desirable to automatically switch or change the emission regulation values and the driving mode, based on information transmitted from a communications station. Thus, the system may be constructed such that communications means receives a desired driving mode from the outside of the vehicle.

Figure 3B:
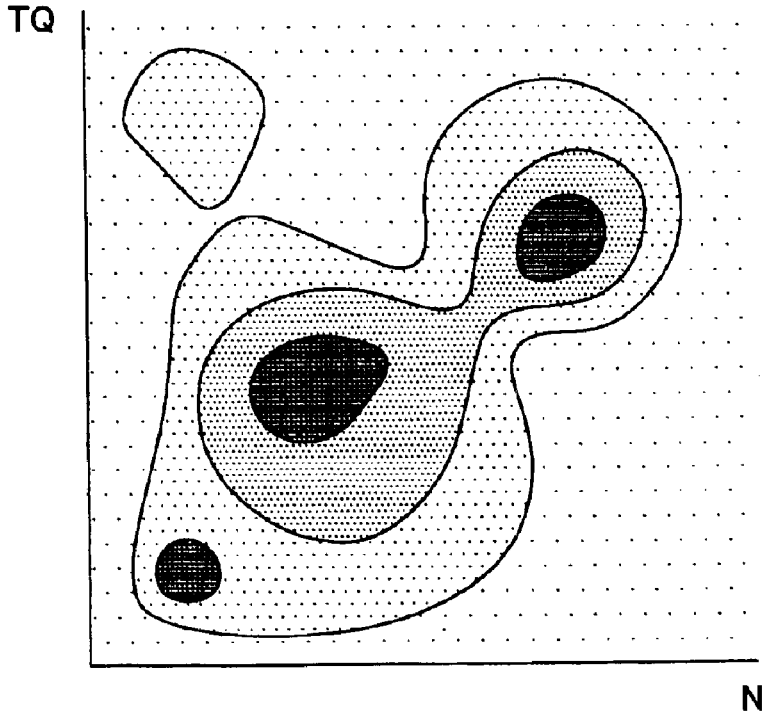
FIG. 3B is a map indicating the frequency of use at each driving point defined by the demanded engine torque TQ and the engine speed N, when the vehicle is caused to run according to the driving mode of FIG. 3A.

In order to calculate the target output values of the exhaust emission amounts in the embodiment of the invention, the vehicle model is initially used to cause the vehicle to run according to the driving mode, thereby to obtain the frequency of use of each driving point (which will be described later) that is defined by the demanded engine torque TQ and the engine speed N. In FIG. 3B showing the distribution of the frequency of use thus obtained, a darker portion indicates a higher frequency of use. In FIG. 3B, the vertical axis indicates demanded engine torque TQ, and the horizontal axis indicates engine speed N. In the example of FIG. 3B, the frequency of use as indicated above is represented by a function of the demanded torque TQ and the engine speed N. Although the driving points as defined by the demanded torque TQ and the engine speed N are grouped into several regions having four different ranges of the frequency of use as indicated by four different degrees of darkness in FIG. 3B, the driving points may be grouped into regions having five or more ranges of the frequency of use.

Figure 4A:
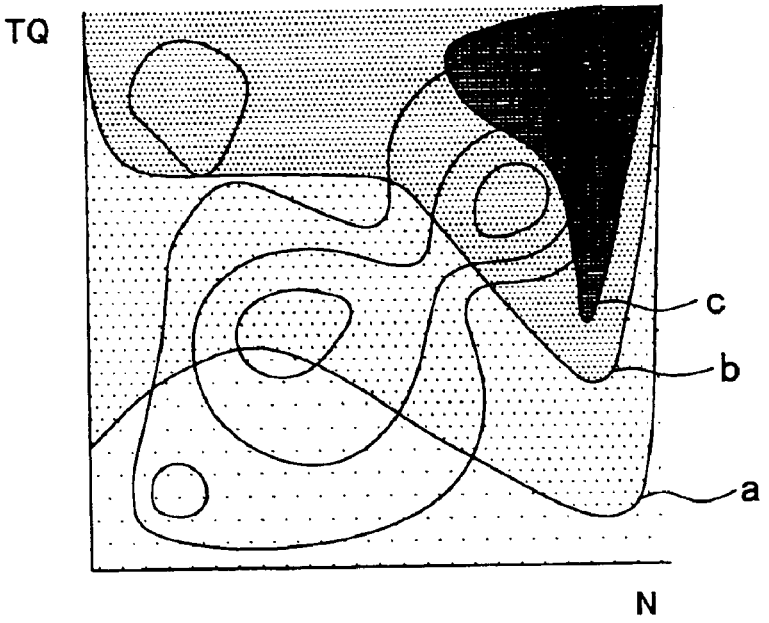
FIG. 4A is a map indicating the NOx amount in addition to the frequency of use when the vehicle runs according to the driving mode of FIG. 3A.

Using the frequency of use map shown in FIG. 3B, the target coordinator 51 determines the target output values of the exhaust emission amounts, for example. As a typical example, the target output values of NOx, are shown in FIG. 4A, in which a darker portion indicates a higher target output value of NOx. In FIG. 4A, the vertical axis indicates the demanded engine torque TQ, and the horizontal axis indicates the engine speed N. In the example of FIG. 4A, the target output value of NOx is represented by a function of the demanded torque TQ and the engine speed N. Although the driving points as defined by the demanded torque TQ and the engine speed N are grouped into several regions having four different ranges of the target output value of NOx as indicated by four different degrees of darkness in FIG. 4A, the driving points may be grouped into regions having five or more ranges of the target output value of NOx. In addition, FIG. 4A also shows the boundaries of the regions defined based on the frequency of use as in FIG. 3B, as well as the regions defined based on the target output value of NOx.

If the frequency of use and the target value of NOx at each of the driving points as defined by the demanded torque TQ and the engine speed N are known, the amount of discharge of NOx at each driving point as defined by the demanded torque TQ and the engine speed N can be calculated by multiplying the frequency of use with the target value of NOx at the driving point in question.

Then, a sum of the products of the frequency of use and the target value of NOx at all of the driving points as defined by the demanded torque TQ and the engine speed N is calculated. In this manner, the estimated total amount of discharge of NOx during running of the vehicle according to the driving mode is obtained from the sum of the products as described above.

If the estimated total amount of discharge of NOx thus calculated is much lower than the mode emission regulation value of NOx, the respective boundary lines a, b and c of the target output value of NOx are moved as a whole toward the lower torque side in FIG. 4A, for example. To the contrary, if the estimated total amount of discharge of NOx thus calculated is higher than the mode emission regulation value of NOx, the respective boundary lines, a, b and c are moved as a whole toward the higher torque side in FIG. 4A. Further, the shape or configuration of each of the boundary lines a, b, and c may also be changed as needed so as to reduce an area in which both the target value of NOx and the frequency of use are relatively high.

The adjustment or correction of each of the boundary lines a, b, and c as described above is performed in the target value coordinator 51 until the estimated total amount of discharge of NOx satisfies the mode emission regulation value for NOx. Once the estimated total amount of NOx satisfies the mode emission regulation value for NOx, the target value of NOx is determined in accordance with the demanded torque TQ and the engine speed N.

Also, a map similar to that of FIG. 4A is prepared for the smoke concentration in the exhaust gas, and boundary lines in the map are adjusted or corrected so that the estimated total amount of discharge of smoke satisfies the mode emission regulation value for the smoke amount, as in the case of NOx. In addition, maps similar to that of FIG. 4A are prepared for the amounts of HC and CO in the exhaust gas, and boundary lines in the maps are adjusted or corrected so that the estimated total amounts of discharge of HC and CO satisfies the respective mode emission regulation values for HC and CO, as in the case of NOx. Furthermore, a target value for the combustion noise is determined in accordance with the demanded engine torque TQ and the engine speed N.

Figure 4B:
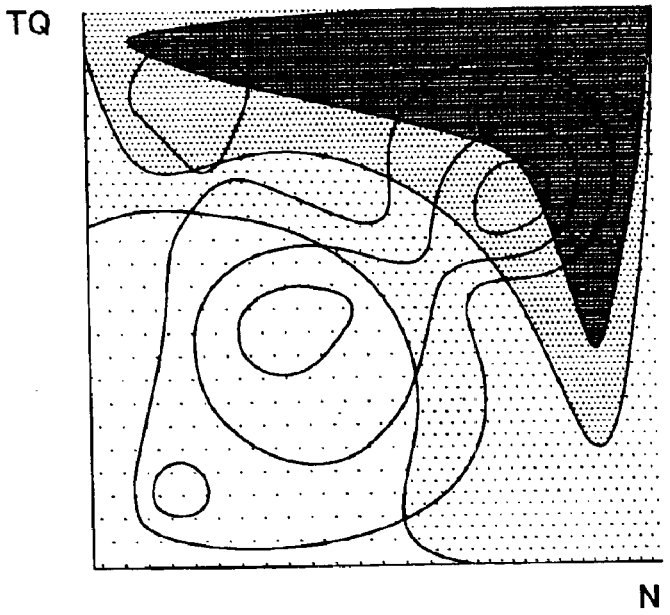
FIG. 4B is a map indicating the fuel economy in addition to the frequency of use when the vehicle runs according to the same driving mode.

FIG. 4B shows the target values of the fuel economy or consumption. As in the map shown in FIG. 4A, the map as shown in FIG. 4B is divided into several driving regions by boundary lines representing the target values of the fuel economy.

In this case, the estimated fuel economy or consumption can also be calculated when the vehicle is running in the above-indicated driving mode. However, it is not necessary to provide a map like that of FIG. 4B with regard to the fuel economy for the reason as described above.

In the manner as described above, the target coordinator 51 calculates the target value of the engine output torque, the target values of the exhaust emission amounts, the target value of the combustion noise, and, in some cases, the target value of the fuel economy. In this case, the target value of the exhaust emission amount, or the like, may be set to different values depending upon the driving conditions of the engine, as is understood from FIG. 4A. In the example shown in FIG. 4A, the target value of NOx is set to one of different values that is selected depending upon the demanded engine torque TQ and the engine speed N. Here, it is also possible to set the target values of the exhaust emission amounts based on either one of the demanded engine torque TQ and the engine speed N.

Further, at least part of the target output values, such as the target output value of NOx amount, may be stored in advance. In another example, the specifications data of the vehicle to be controlled may be stored in advance, and at least part of the target output values may be calculated from the specifications data thus stored. Moreover, at least part of the target output values may be stored in the replaceable storage medium 42, or part of the target output values may be received from the outside of the vehicle by communication means.

After the respective target output values are calculated by the target coordinator 51, these target output values are transmitted to the control amount coordinator, in which an adaptation operation for the vehicle is performed. Namely, the control amount coordinator searches for appropriate values of the input control parameter values so that the output values of the vehicle become equal to the corresponding target output values or fall within the permissible adaptation ranges of the corresponding target output values.

As shown in FIG. 2, the target output values calculated by the target value coordinator 51 are transmitted to the function block 53 called the control amount initial value, and to the optimizer 54. The function block 53 outputs the initial values of the input control parameters. Although any value may be used as the initial value, the initial values used in this embodiment of the invention are basic input parameter values that provide target output values depending upon the engine operating state. These basic parameter values are stored in advance in the ROM 32 or in the replaceable storage medium 42, for example, in the form of a map as a function of the demanded engine torque and the engine speed.

On the other hand, output values of the optimizer 54 are respectively added to the initial values of the input control parameters generated from the function block 53, and the results of the addition are transmitted to the vehicle model as temporary input control parameter values. The vehicle model calculates the output values based on the temporary input control parameter values, and the output values thus obtained are then transmitted to the optimizer 54 of the control amount coordinator. On the basis of these output values, the optimizer 54 outputs correction values for the input control parameters so that the output values of the vehicle model approach the target output values. In other words, the optimizer 54 searches for the input control parameters that make the output values of the vehicle equal to the target output values or held within the allowable adaptation range.

Next, an operation performed by the optimizer 54 for searching for the input control parameters will be explained.

As described above, a combination of one or more input control parameters suitable for adaptive control, with each of the output values of the vehicle, is predetermined for the purpose of searching for the input control parameters. In one embodiment of the invention, the combination is that of one input control parameter and one output value that changes with the highest sensitivity when the input control parameter is changed. A list of such combinations of the input control parameters and the output values used in the embodiment of the invention is provided as follows:

(a) a combination of the fuel injection amount and the engine output torque,
(b) a combination of the fuel injection timing and the fuel economy,
(c) a combination of the oxygen concentration in the intake gas supplied into combustion chambers and the amount of NOx emitted from the combustion chambers,
(d) a combination of the fuel injection pressure and the smoke concentration in the exhaust gas emitted from the combustion chambers, and
(e) a combination of the amount of pilot fuel injection prior to main fuel injection and the combustion noise.

With regard to the combination (a), the engine output torque increases with high sensitivity in response to an increase in the fuel injection amount.

With regard to the combination (b), the fuel economy improves with high sensitivity when the fuel injection timing is advanced and the amount of unburned HC is reduced.

With regard to the combination (c), the combustion temperature is lowered with a reduction in the oxygen concentration in the intake air, and the NOx amount is accordingly reduced with high sensitivity in response to the reduction in the oxygen concentration.

With regard to the combination (d), when the fuel injection pressure is increased, atomization of the injected fuel is promoted, and therefore the smoke concentration is reduced with high sensitivity.

With regard to the combination (e), when the pilot injection amount is increased, the rate of increase of the fuel pressure during the main fuel injection is reduced, and therefore the combustion noise is reduced with high sensitivity.

Further, in the embodiment of the invention, the respective input control parameters are simultaneously controlled in a feedback manner so that each of the output values combined with a corresponding one of the input parameters becomes equal to the corresponding target output value. Thus, adapted values of the input control parameters can be found out. More specifically, the fuel injection amount is feedback-controlled so that the engine output torque becomes equal to a target output value thereof, while at the same time the oxygen concentration in the intake air is feedback-controlled so that the NOx amount becomes equal to a target output value that depends upon the operating state of the engine. At the same time, the fuel injection pressure is feedback-controlled so that the smoke concentration becomes equal to a target output value that depends upon the operating state of the engine. At the same time, the pilot injection amount is feedback-controlled so that the combustion noise becomes equal to a target output value that depends upon the operation state of the engine. The fuel injection timing is controlled so that the fuel economy is improved as much as possible.

As described above, when the respective input control parameters are simultaneously feedback-controlled, each of the input control parameter values is automatically changed while being coordinated with other parameters until each of the output values becomes equal to the corresponding target value, thereby to achieve adaptation of the input control parameters.

In the embodiment of the invention, the feedback control is performed by proportional integral control. Namely, when "P" represents a proportional component, and "I" represents an integral component, the correction amount ΔF for each of the input control parameters, which is generated from the optimizer 54, is calculated according to the following expressions:

$$I=I+Ki(\text{the output value}-\text{the target output value})$$

$$P=Kp(\text{the output value}-\text{the target output value})$$

$$\Delta F=P+I$$

where Ki and Kp are proportional constants.

In the embodiment of the invention, the output values generated from the vehicle model are used as the output values for calculating the above-described component I and component P. However, the output values detected in the actual vehicle 45 may be used as the output values for calculating the component I and component P.

The feedback control of the input control parameters may be performed assuming that the input control parameters and the output values that are respectively in combination with the input control parameters are in proportional relationships. For example, the fuel injection amount as one of the input control parameters may be feedback-controlled on the assumption that the relationship between the fuel injection amount and the engine output torque is expressed as "engine output torque=K·fuel injection amount" where K is a proportional constant. In this case, the proportional constant Ki in the component I as indicated above has a constant value, and the proportional constant Kp in the component P also has a constant value.

Figure 5:
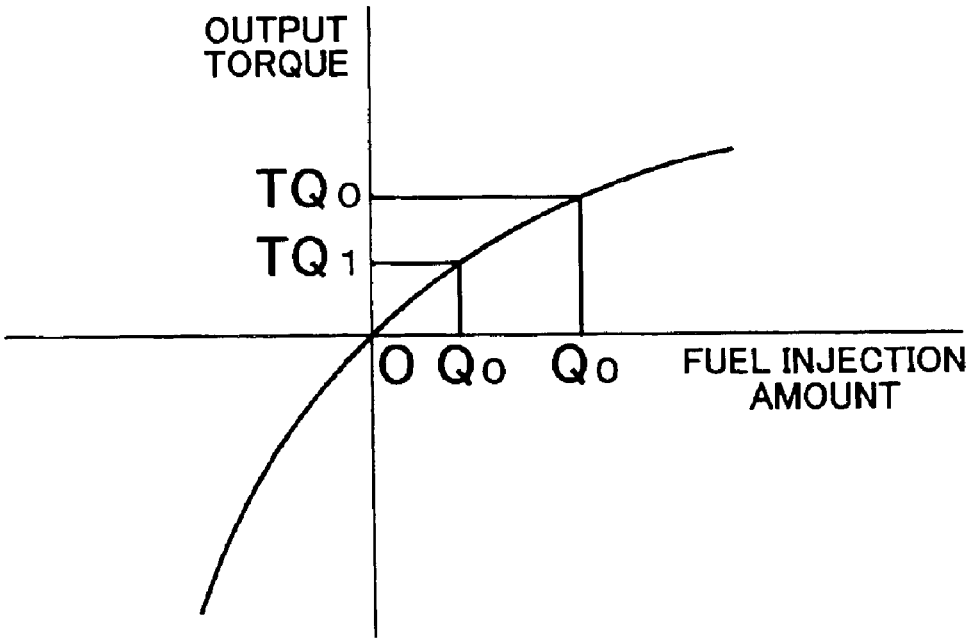
FIG. 5 is a graph indicating a sensitivity function that represents a relationship between a fuel injection amount and engine output torque.

In another embodiment of the invention, in order to perform the optimum adaptation operation, the relationship between each of the input control parameters and a corresponding one of the output values takes the form of a function of sensitivity or responsiveness. In accordance with the sensitivity obtained from the sensitivity function, the input control parameters are controlled in a feedback manner. For example, the sensitivity function between the fuel injection amount and the engine output torque is shown in FIG. 5. In this connection, it is to be noted that each sensitivity function is obtained with respect to the vicinity of the initial value generated from the function block 53 of FIG. 2, that is, the vicinity of the basic input control parameter value.

When feedback control of each of the input control parameters is performed by using the sensitivity function, at least one of the proportional constant Kp in the component I and the proportional constant Kp in the component P of the proportional integral control as described above is changed according to the sensitivity obtained from the sensitivity function. In the example of FIG. 5, it is assumed that the fuel injection amount and the output torque are currently equal to zero, and the target values of the fuel injection amount and the output torque are $Q_0$ and $TQ_0$, respectively. In this case, an amount of increase ($Q_1 \rightarrow Q_0$) of the fuel injection amount required for increasing the output torque from $TQ_1$ to $TQ_0$ is larger than an amount of increase ($\mathbf{0} \rightarrow Q_1$) of the fuel injection amount required for increasing the output torque from zero to $TQ_1$. Namely, in order to converge the output torque on the target value in a short time using the proportional integral control, the amount of increase of the fuel injection amount needs to be increased as the output torque approaches the target value. In other words, as the output torque approaches the output target, the proportional constant Ki or Kp needs to be increased. Generally speaking, as the sensitivity of the increase in the output value in response to the increase in the input control parameter value is reduced, the value of the proportional constant Ki or Kp needs to be increased.

Thus, in the embodiment of the invention, the sensitivity function is set for each combination of the input control parameter and the output value, and the proportional constant Ki or Kp is set to a larger value as the sensitivity of the increase of the output value in response to the increase in the input control parameter is lowered. In this manner, each input control parameter is quickly converged on the parameter adaptation value while being coordinated with the other input control parameters.

In the embodiment of the invention, the sensitivity function for each input control parameter is determined by learning from the input control parameter supplied to the vehicle model and the output value of the vehicle model that is in combination with the input control parameter in question.

In actual situations, however, when one of the input control parameter values is changed, all of output values associated with the input control parameter are changed. In other words, each of the output values is affected by a plurality of the input control parameters. Accordingly, a combination of each of the output values and a plurality of input control parameters may be established, and each of the output values may be made equal to the corresponding target output value or controlled to be within the permissible range of the target output value, by changing the above-indicated plurality of input control parameters that are in combination of the output value in question.

As described above, adaptation of the input control parameters may be achieved when each of the output values falls within the permissible range of the corresponding target output value even if it is not exactly equal to the target output value. Therefore, in the embodiment of the invention, the adaptation of the input control parameters is judged as being accomplished if each of the output values is within the permissible adaptation range of the corresponding target output value even if it does not become equal to the target output value. In one embodiment of the invention, evaluation means is used for evaluating or determining whether each output value is within the permissible range of the target output value is evaluated by evaluation means. The evaluation means will be hereinafter explained.

Figure 6A:
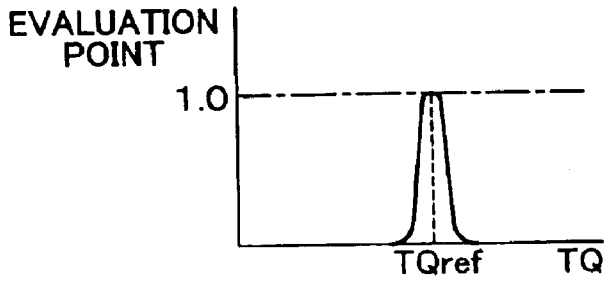
FIG. 6A, FIG. 6B and FIG. 6C are graphs showing evaluation point functions for output torque, NOx amount, and fuel economy, respectively.
Figure 6B:
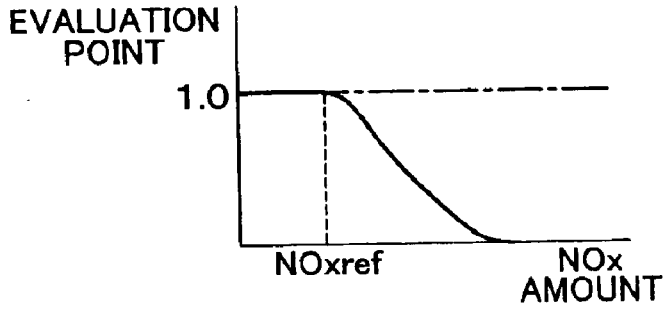
Figure 6C:
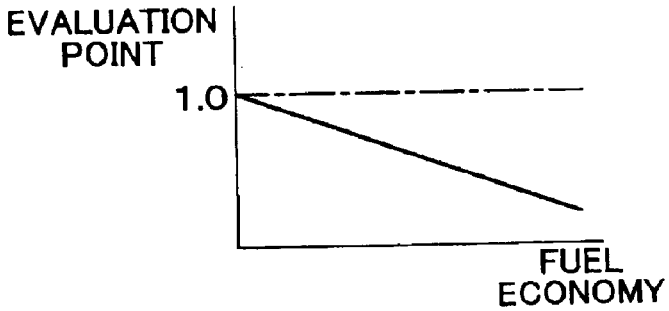

In the embodiment of the invention, an evaluation point function is established for each of the output values in order to evaluate whether each of the output values is within the permissible range of the target output value. An example of a set of evaluation point functions is shown in FIG. 6A, FIG. 6B, and FIG. 6C. FIG. 6A shows an evaluation point function for the torque TQ, and FIG. 6B shows an evaluation point function for the NOx amount, while FIG. 6C shows an evaluation point function for the fuel economy.

In the example as shown in FIG. 6A, FIG. 6B and FIG. 6C, each of the evaluation point functions is a function of the output value taken as the horizontal axis and the evaluation point taken as the vertical axis. The evaluation point determined by each evaluation point function reaches its peak or takes the largest value when the output value is equal to the target value or is within the target range. In the example of FIG. 6A to FIG. 6C, the maximum value of the evaluation point is equal to 1.0.

As described above, FIG. 6A shows an evaluation point function for the torque TQ. On the horizontal axis of FIG. 6A, $TQ_{ref}$ represents a reference value, namely, the target value of the output torque. In this evaluation point function, the evaluation point becomes equal to the maximum value, i.e., 1.0, when the output torque is equal to the target value $TQ_{ref}$, and sharply drops when the output torque deviates from the target value $TQ_{ref}$ to either the lower torque side or the higher torque side.

As also described above, FIG. 6B shows an evaluation point function for the NOx amount. On the horizontal axis of FIG. 6B, $NOx_{ref}$ represents a reference value, namely, the target value of the NOx amount. The evaluation point defined by this evaluation point function becomes equal to the maximum value, i.e., 1.0, when the NOx amount is equal to or smaller than the target value $NOx_{ref}$. The evaluation point is reduced as the NOx amount becomes larger than the target value $NOx_{ref}$, as shown in FIG. 6B.

FIG. 6C shows an evaluation point function for the fuel economy. It will be understood from FIG. 6C that the evaluation point in this evaluation point function decreases as the fuel economy deteriorates.

Various methods may be considered for evaluating whether each of the output values is within the permissible adaptation range of the target value by using these evaluation point functions. Some of these methods will be hereinafter explained.

In the first evaluation method, which is the simplest one, each of the output values is determined to be within the permissible adaptation range of the target output value when all of the evaluation points for the respective output values exceed a certain value, for example, 0.9.

In the second evaluation method, different reference points are set for the respective output values; for example, the reference point is set to 0.9 for the output torque, and is set to 0.8 for the NOx amount. When each of the output values exceeds the corresponding reference point, it is evaluated or determined that each of the output values is within the permissible adaptation range.

In the third evaluation method, each of the output values is evaluated as being within the permissible adaptation range, when the relationship among the evaluation points relating to the respective output values satisfies a certain condition that indicates that adaptation of these output values is achieved. In this method, the relationship among the evaluation points refers to, for example, a sum of the evaluation points or a product of the evaluation points. Thus, in the third evaluation method, each of the output values is evaluated as being within the permissible range of the target output value, for example, when the sum of the evaluation points exceeds a predetermined reference point, or when the product of the evaluation points exceeds a predetermined reference point.

As mentioned above, there are various methods for evaluating whether each of the output values is within the permissible range of the target output value. However, there is no difference among the evaluation methods in terms of using the evaluation point for each of the output values.

In another evaluation method, a difference between each of the output values and the corresponding target output value may be used in place of the evaluation points. In this case, each of the output values is evaluated as being within the permissible adaptation range of the target value when the difference associated with each of the output values is smaller than a corresponding reference value, or when the relationship among the differences associated with the output values satisfies a certain condition that indicates that adaptation of these output values is achieved.

Next, the meaning of the shape of each of the evaluation point functions as shown in FIG. 6A, FIG. 6B and FIG. 6C will be explained. As described above, no matter which one of the evaluation methods is used, each of the output values is not evaluated as being within the permissible adaptation range unless all of the evaluation points for the respective output values are higher than a certain point. In the case where the evaluation point function takes the shape of a pulse as shown in FIG. 6A, the output value does not fall within the permissible adaptation range unless the output value is around the target output value. In this case, the output value is judged as being adapted when the output value becomes substantially equal to the target output value.

In FIG. 6A showing the evaluation point function for the output torque, the output torque is judged as being adapted when the output torque becomes almost equal to the target value. Thus, the pulse-shaped evaluation point function as shown in FIG. 6A is used when the output value is desired to be substantially equal to the target output value.

On the other hand, since the evaluation point function is shaped as shown in FIG. 6B, the evaluation point is not reduced so much even if the output value, i.e., the NOx amount in this example, becomes a little larger than target output value, i.e., $NOx_{ref}$. Namely, the evaluation point is not rapidly reduced as the NOx amount exceeds the target value $NOx_{ref}$. In other words, the output value is judged as being in the permissible range even if it is somewhat larger than the target output value. On the contrary, if the NOx amount is desired not to exceed the target value $NOx_{ref}$ at all, the evaluation point function may be designed such that the evaluation point suddenly changes from 1.0 to 0 once the NOx amount exceeds the target value $NOx_{ref}$.

The evaluation point function having a shape as shown in FIG. 6B may be used for the smoke concentration, the HC amount, the CO amount, the combustion noise, and the like.

With regard to the evaluation point function as shown in FIG. 6C, the evaluation point does not become larger unless the output value is reduced. Namely, in the example as shown in FIG. 6C, the evaluation point is not increased unless the fuel economy is improved. In other words, the fuel economy is judged as being in the permissible adaptation range when it is improved.

As described above, an attempt to improve the fuel economy may result in an increase in the NOx amount. Since the evaluation point is equal to 1.0 as long as the NOx amount is equal to or smaller than the target value $NOx_{ref}$, it is desirable to improve the fuel economy as much as possible by increasing the NOx amount to the target value. If the NOx amount exceeds the target value $NOx_{ref}$, on the other hand, the evaluation point for the NOx amount is reduced whereas the evaluation point for the fuel economy is increased since the fuel economy is improved in this case. The final NOx amount and fuel economy are determined in view of the balance of the evaluation points thereof, so that the sum of the evaluation points is maximized, for example.

In another embodiment of the invention, the evaluation function for the fuel economy as shown in FIG. 6C is not provided, since the higher evaluation is obtained with any improvement in the fuel economy. In this embodiment, it is determined, according to one of the first, second and third evaluation methods as described above, whether the output values other than the fuel economy are within the permissible adaptation ranges. In this case, the fuel economy is improved as much as possible provided that each of the output values, except the fuel economy, is within the permissible adaptation range.

It will be understood from the above description that the evaluation point functions are used for evaluating whether each of the output values is within the permissible adaptation range or not. In addition to the above-described evaluation, the evaluation point function may also be used for adaptive control over input control parameters that are feedback-controlled so as to provide desired output values. The use of the evaluation point functions for the adaptive control will be hereinafter explained in detail.

When an evaluation point for a certain output value is lower than evaluation points for the other output values, it is desirable in terms of the adaptive control to make the output value having the lower evaluation point close to the target value before controlling the other output values. In this case, therefore, the input control parameter(s) that is/are in combination with the output value having the lower evaluation point is/are changed first (i.e., prior to control of the other input control parameters), so that the output value having the lower evaluation value approaches the target output value before the other output values do. For example, when the evaluation point for the output torque is lower than the evaluation points for the other output values, the fuel injection amount is controlled before the other input control parameters are controlled.

When the evaluation point function includes sharply inclined portions as shown in FIG. 6A, the evaluation point is suddenly reduced as the output torque TQ deviates from the target value $TQ_{ref}$. When the evaluation point function includes a mildly or gently inclined portion as shown in FIG. 6B, on the other hand, the evaluation point is not reduced so much even if the NOx amount deviates from the target value $NOx_{ref}$ to the larger side. Accordingly, it is unnecessary, in view of the adaptive control, to quickly control the NOx amount to be close to the target value $NOx_{ref}$. In the embodiment of the invention, therefore, the input control parameters are feedback-controlled so that the output value whose evaluation point function includes sharply inclined portions is quickly controlled to be close to the target output value. More specifically, for the output value whose evaluation point function includes sharply inclined portions, at least one of the proportional constant Ki in the component I and the proportional constant Kp in the component P for use in the proportional integral control is increased.

Furthermore, it is desirable to make a selected one of the output values close to the corresponding target output value, in preference to the other output values, depending upon the operating state of the engine. For example, while the engine is in the steady driving mode, more importance or weight is placed on the fuel economy, and it is therefore desirable to preferentially change the input control parameter(s) associated with the fuel economy. While the engine is in the accelerating operating mode, on the other hand, more importance is placed on the output torque, and it is therefore desirable to preferentially change the input control parameter(s) associated with the output torque. Accordingly, in this embodiment of the invention, a selected input control parameter or parameters is/are changed prior to the other input control parameters, depending upon the operating state of the engine.

When the optimizer 54 as shown in FIG. 2 determines that each of the output values is within the permissible adaptation range of the target output value, it judges that adaptation of the input control parameters is completed, and the input control parameter values obtained at this time are considered as the adapted parameter values. At the same time, the function block 55 called the convergence judgment receives the judgment as to completion of the adaptation operation, and the adapted parameter values of the respective input control parameters are transmitted to the vehicle 45 for control thereof. Subsequently, the next adaptation operation is started.

The above-described adaptation operation for the input control parameters may be performed in various timings. For example, the adaptation operation may be always performed while the vehicle is in operation. Alternatively, the adaptation operation may be performed as needed, for example, before launching the vehicle to the market.

In some cases, during the adaptation operation as described above, one of the output values fails to be within the permissible adaptation range of the target value, in other words, it comes out of the permissible adaptation range. In this case, it is judged that an error occurs in an engine control portion associated with the input parameter(s) that is/are in combination with the output value that is out of the permissible range. With this judgement made, an alarm is generated so as to inform the vehicle operator of the error.

Further, in one embodiment of the invention, each adaptation operation is performed within a limited computation period of time. In this case, when any of the output values does not become equal to the corresponding target output value or does not fall within the permissible adaptation range of the target output value within the limited computation time, it is judged that an error occurs in the control system, and an alarm or warning to this effect is generated.

When the output values become equal to the corresponding target values or fall within the permissible adaptation ranges of the target values within the limited computation time period, the input control parameters at this time are temporarily stored as normal input control parameters to be established in the engine operating state at this time. Then, the normal input control parameters thus stored may be used as the input control parameters in the same operating state of the engine when the output values do not come within the permissible adaptation range of the target output values within the limited computation time.

Figure 7:
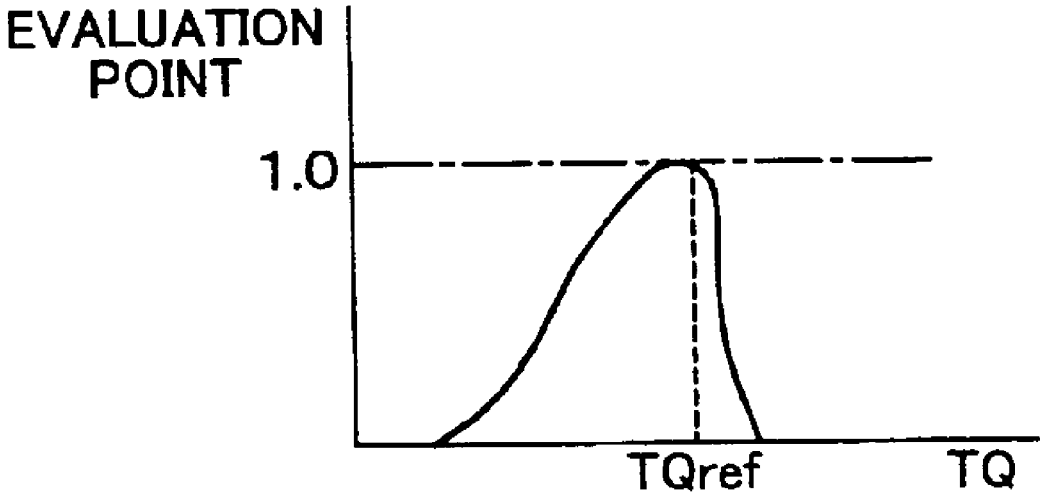
FIG. 7 is a graph showing another example of an evaluation point function for the output torque.

When an error occurs in the engine control portion or in the control system, the top priority is given to satisfaction of the mode emission regulation values, rather than the drivability of the vehicle. In this case, the evaluation point function for the output torque is designed as shown in FIG. 7 such that the evaluation point is more gently or slowly reduced as the output torque TQ becomes smaller than the target value $TQ_{ref}$. In other words, the evaluation point for the output torque is relatively high even if the output torque TQ is reduced to be smaller than the target value $TQ_{ref}$. When the adaptation operation is performed using the evaluation point function of FIG. 7, the mode emission regulation values are satisfied though the output torque is likely to be smaller than the target value, in other words, the drivability of the vehicle tends to be reduced.

It is to be noted that a program associated with the adaptation operation as explained above may be stored in a storage medium, such as the storage medium 42.

With the system arranged as described above, the adaptation operation of the input control parameters of the vehicle or the engine may be automatically performed on-board.

What is claimed is:

1. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, and a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value, wherein the output values of the vehicle comprise output values of an internal combustion engine, the output values of the internal combustion engine include at least two of output torque, fuel economy and amounts of exhaust emissions of the engine, and the input control parameters comprise input control parameters for the internal combustion engine.

2. A control apparatus according to claim 1, wherein the input control parameters include at least a fuel injection amount and fuel injection timing.

3. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, and a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value, and wherein the combination is a combination of a selected one of the input control parameters and a selected one of the output values that changes with high sensitivity in response to a change in the selected one of the input control parameters, and wherein the selected one of the input control parameters is fuel injection timing, and the selected one of the output values is fuel economy.

4. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, and a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value, and wherein the combination is a combination of a selected one of the input control parameters and a selected one of the output values that changes with high sensitivity in response to a change in the selected one of the input control parameters, and wherein the selected one of the input control parameters is an oxygen concentration in intake gas supplied into a combustion chamber, and the selected one of the output values is an amount of NOx discharged from the combustion chamber.

5. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, and a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value, and wherein the combination is a combination of a selected one of the input control parameters and a selected one of the output values that changes with high sensitivity in response to a change in the selected one of the input control parameters, and wherein the selected one of the input control parameters is an amount of fuel injected upon pilot injection performed prior to main fuel injection, and the selected one of the output values is combustion noise.

6. A control apparatus according to claim 1, wherein the combination is a combination of a selected one of the output values and a plurality of selected ones of the input control parameters, and wherein the selected ones of the input control parameters that are in combination with the selected one of the output values are changed so that each of the output values becomes substantially equal to the corresponding target output value or falls within the permissible adaptation range of the target output value.

7. A control apparatus according to claim 1, wherein the respective input control parameters are simultaneously feedback-controlled so that each of the output values that is in combination with the at least one of the input control parameters becomes substantially equal to the corresponding target output value, whereby the adapted value setting unit determines the adapted values of the input control parameters.

8. A control apparatus according to a claim 7, wherein a relationship between a selected one of the input control parameters and a selected one of the output values that is in combination with the selected one of the input control parameters is represented by a sensitivity function, and the selected one of the input control parameters is feedback-controlled in accordance with the sensitivity obtained from the sensitivity function.

9. A control apparatus according to claim 8, wherein the sensitivity function is determined by learning based on changes in the selected one of the output values with respect to the selected one of the input control parameters.

10. A control apparatus according to claim 7, wherein a selected one of the input control parameters and a selected one of the output values that is in combination with the selected one of the input control parameters are proportional to each other.

11. A control apparatus according to claim 1, wherein the output value acquiring unit acquires output values detected in an actual vehicle, as the output values of the vehicle.

12. A control apparatus according to claim 1, wherein the vehicle model is modified based on the estimated output values of the vehicle model and output values detected in the actual vehicle, so that the estimated output values of the vehicle model substantially coincide with the output values detected in the actual vehicle.

13. A control apparatus according to claim 1, wherein the vehicle model is replaceable by another vehicle model suitable for a vehicle to be controlled.

14. A control apparatus according to claim 13, wherein the vehicle model is stored in a replaceable storage medium.

15. A control apparatus according to claim 13, wherein the vehicle model is constructed by receiving specifications data of the vehicle to be controlled, and the specifications data is stored in a replaceable storage medium.

16. A control apparatus according to claim 1, wherein a combination between each of the estimated output values of the vehicle model and at least one of the input control parameters suitable for adaptive control with respect to the each estimated output value is established; and when any one of the estimated output values of the vehicle model is out of a permissible adaptation range of a corresponding target output value, it is judged that an error occurs in an engine control portion associated with the at least one of the input control parameters that is in combination with the estimated output value.

17. A control apparatus according to claim 1, wherein the adaptive control unit always performs adaptive control of the input control parameters.

18. A control apparatus according to claim 1, wherein the adaptive control unit performs adaptive control of the input control parameters as needed.

19. A control apparatus according to claim 1, wherein the adaptive control unit performs adaptive control of the input control parameters within a limited computing time.

20. A control apparatus according to claim 19, wherein it is judged that an error occurs in a control system when the output values of the vehicle fail to be equal to the corresponding target output values or fail to be within the permissible adaptation ranges of the target output values within the limited computing time.

21. A control apparatus according to claim 19, further comprising:

a storage unit that temporarily stores the input control parameters obtained when the output values of the vehicle become substantially equal to the corresponding target output values or fall within the permissible adaptation ranges of the target output values while the vehicle is in a certain operating state, as normal input control parameters in the certain operating state, wherein the stored normal input control parameters are used as the input control parameters to be feedback-controlled when the vehicle is in the certain operating state, if the output values of the vehicle fail to be within the permissible adaptation ranges of the target output values within the limited computing time.

22. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value;

a target output value setting unit that sets the target output values, wherein the target output values include at least two of target values of engine output torque, fuel economy, and amounts of exhaust emissions of an internal combustion engine.

23. A control apparatus according to claim 22, wherein the amounts of the emissions include an amount of NOx discharged from a combustion chamber of the engine.

24. A control apparatus according to claim 22, wherein each of at least one of the target output values is set to different values depending upon an operating state of the internal combustion engine.

25. A control apparatus according to claim 24, wherein the operating state of the engine comprises at least one of a demanded torque of the engine and an engine speed.

26. A control apparatus according to claim 22, further comprising a memory in which at least a part of the target output values is stored in advance.

27. A control apparatus according to claim 22, wherein at least a part of the target output values is calculated based on specifications data of the vehicle.

28. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value;

a target output value setting unit that sets the target output values, wherein at least a part of the target output values is calculated based on specifications data of the vehicle;

a vehicle model that receives the input control parameters and generates estimated output values of an actual vehicle, wherein a frequency of use of engine operating points defined by an operating state of the engine is obtained by using the vehicle model that causes the vehicle to run in a predetermined driving mode, and the target output values are calculated using the frequency of use.

29. A control apparatus according to claim 28, wherein the driving mode is stored in a replaceable storage medium.

30. A control apparatus according to claim 28, wherein the driving mode is received from an outside of the vehicle by a communications device.

31. A control apparatus according to claim 22, wherein at least a part of the target output values is stored in a replaceable storage medium.

32. A control apparatus according to claim 22, wherein at least a part of the target output values is received from an outside of the vehicle by a communications device.

33. A control apparatus according to claim 1, further comprising an evaluating unit that determines whether each of the output values is within the permissible adaptation range of the corresponding target output value.

34. A control apparatus according to claim 33, wherein the evaluating unit determines that the each output value is within the permissible adaptation range of the target output value when a difference between the each output value and the corresponding target output value is smaller than a corresponding reference value, or when a relationship among differences between the output values and the corresponding target output values satisfies a predetermined condition.

35. A control apparatus according to claim 33, wherein the evaluating unit establishes an evaluation function with respect to each of the output values, the evaluation function being designed such that an evaluation point reaches a maximum thereof when the output value is equal to the target output value, and the evaluating unit determines whether the each output value is within the permissible adaptation range of the corresponding target output value, based on the evaluation point for the each output value.

36. A control apparatus according to claim 35, wherein the evaluating unit determines that the each output value is within the permissible adaptation range of the corresponding target output value, when the evaluation point for the each output value is larger than a reference value or when a relationship among the evaluation points for the respective output values satisfies a predetermined condition.

37. A control apparatus according to claim 35, wherein the evaluating unit establishes an evaluation function with respect to output torque of an internal combustion engine, the evaluation function for the output torque being designed such that the evaluation point reaches a maximum thereof when the output torque of the engine is equal to a target value thereof, and is rapidly reduced when the output torque deviates from the target value on either of larger-torque and smaller-torque sides.

38. A control apparatus according to claim 35, wherein the evaluating unit establishes an evaluation function with respect to an amount of NOx discharged from a combustion chamber of an international combustion engine, the evaluation function for the NOx amount being designed such that the evaluation point reaches a maximum thereof when the NOx amount is equal to or smaller than a target value thereof, and is reduced as the NOx amount exceeds the target value.

39. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value;

an evaluating unit that determines whether each of the output values is within the permissible adaptation range of the corresponding target output value, wherein the evaluating unit establishes an evaluation function with respect to each of the output values, the evaluation function being designed such that an evaluation point reaches a maximum thereof when the output value is equal to the target output value, and the evaluating unit determines whether the each output value is within the permissible adaptation range of the corresponding target output value, based on the evaluation point for the each output value, wherein the evaluating unit establishes an evaluation function with respect to an amount of NOx discharged from a combustion chamber of an internal combustion engine, the evaluation function for the NOx amount being designed such that the evaluation point reaches a maximum thereof when the NOx amount is equal to or smaller than a target value thereof, and is reduced as the NOx amount exceeds the target value, and wherein the adaptive control unit changes at least one of the input control parameters associated with fuel economy so as to improve the fuel economy when the NOx amount is equal to or smaller than the target value.

40. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, and a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value;

an evaluating unit that determines whether each of the output values is within the permissible adaptation range of the corresponding target output value, wherein the evaluating unit establishes an evaluation function with respect to each of the output values, the evaluation function being designed such that an evaluation point reaches a maximum thereof when the output value is equal to the target output value, and the evaluating unit determines whether the each output value is within the permissible adaptation range of the corresponding target output value, based on the evaluation point for the each output value, and wherein the evaluating unit establishes an evaluation function with respect to fuel economy, the evaluation function being designed such that the evaluation point decreases as the fuel economy deteriorates.

41. A control apparatus according to claim 35, wherein a combination of each output value of the vehicle and at least one of the input control parameters suitable for adaptive control with respect to the each output value is established; and when the evaluation point for one of the output values is lower than the evaluation point for another output value, the adaptive control unit changes the at least one input control parameter that is in combination with the output value having the lower evaluation point, before changing the at least one input control parameter that is in combination with the output value having the higher evaluation point.

42. A control apparatus for a motor vehicle, in which each of a plurality of output values of the vehicle varies depending upon a plurality of input control parameters for controlling the vehicle, comprising:

an adaptive control unit that changes the plurality of input control parameters so that each of the plurality of output values becomes substantially equal to a corresponding target output value;

an adapted value setting unit that determines adapted values of the input control parameters, based on values of the input control parameters obtained when each of the output values becomes substantially equal to the corresponding target output value or falls within a permissible adaptation range of the target output value, an output value acquiring unit that acquires the output values of the vehicle, and a vehicle model that receives the input control parameters and generates estimated output values of an actual vehicle, wherein the output value acquiring unit acquires the estimated output values from the vehicle model, as the output values of the vehicle and wherein the vehicle is controlled based on the adapted values of the input control parameters that are determined by the adapted value setting unit, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value;

an evaluating unit that determines whether each of the output values is within the permissible adaptation range of the corresponding target output value, wherein the evaluating unit establishes an evaluation function with respect to each of the output values, the evaluation function being designed such that an evaluation point reaches a maximum thereof when the output value is equal to the target output value, and the evaluating unit determines whether the each output value is within the permissible adaptation range of the corresponding target output value, based on the evaluation point for the each output value, and wherein a combination of each output value of the vehicle and at least one of the input control parameters suitable for adaptive control with respect to the each output value is established;

the evaluation function for each of the output values includes an inclined portion along which the evaluation point decreases from a maximum thereof as the output value deviates from the corresponding target output value; and the adaptive control unit performs feedback control of the input control parameters so that each of the output values approaches the corresponding target output value at a rate that increases with an increase in a degree of inclination of the inclined portion of the evaluation function for the output value.

43. A control apparatus according to claim 1, wherein the adaptive control unit changes at least one input parameter selected from the plurality of the input control parameters, so that a selected one of the output values, in preference to the other output values, is made close to the corresponding target output value.

44. A control apparatus according to claim 43, wherein the selected one of the output value changes depending upon an operation state of an internal combustion engine.

45. A control apparatus according to claim 1, wherein the adapted value setting units sets the adapted values of the input control parameter to such values of the input control parameters that are obtained when each of the output values becomes substantially equal to the corresponding target output value or falls within the permissible adaptation range of the target output value.

46. A storage medium storing a program that causes a computer to perform functions of a control apparatus for a motor vehicle, in which each of a plurality of output values of the vehicle varies depending upon a plurality of input control parameters for controlling the vehicle, the program including instructions that cause the computer to perform the steps of:

changing the plurality of input control parameters so that each of the plurality of output values becomes substantially equal to a corresponding target output value;

determining adapted values of the input control parameters, based on values of the input control parameters obtained when each of the output values becomes substantially equal to the corresponding target output value or falls within a permissible adaptation range of the target output value, acquiring the output values of the vehicle, and receiving the input control parameters by a vehicle model, and generating estimated output values of an actual vehicle from the vehicle model, wherein the output values of the vehicle are the estimated output values generated from the vehicle model, and wherein the vehicle is controlled based on the determined adapted values of the input control parameters, a combination of each of the output values and at least one of the input control parameters suitable for adaptive control with respect to the each output value is established, and the at least one of the input control parameters that is in combination with the each output value is changed so that the each output value becomes substantially equal to the corresponding target output value or falls within the permissible adaptation range of the target output value, wherein the output values of the vehicle comprise output values of an internal combustion engine, the output values of the internal combustion engine include at least two of output torque, fuel economy and amounts of exhaust emissions of the engine, and the input control parameters comprise input control parameters for the internal combustion engine.

* * * * *